US006951132B2

(12) United States Patent
Davenport et al.

(10) Patent No.: US 6,951,132 B2
(45) Date of Patent: Oct. 4, 2005

(54) RAIL AND TRAIN MONITORING SYSTEM AND METHOD

(75) Inventors: David Michael Davenport, Niskayuna, NY (US); Nick Andrew Van Stralen, Ballston Lake, NY (US); Thomas James Batzinger, Burnt Hills, NY (US); Robert Snee Gilmore, Burnt Hills, NY (US); Paul Kenneth Houpt, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 35 days.

(21) Appl. No.: 10/609,832

(22) Filed: Jun. 27, 2003

(65) Prior Publication Data

US 2004/0261533 A1 Dec. 30, 2004

(51) Int. Cl.[7] ..... G01N 29/04; B61L 23/04

(52) U.S. Cl. ..... 73/598; 73/602; 73/659; 246/169 S

(58) Field of Search ..... 73/593, 597, 598, 73/599, 600, 602, 636, 659; 246/167 R, 169 R, 169 S, 122 R, 121

(56) References Cited

U.S. PATENT DOCUMENTS

| | | | | | |
|---|---|---|---|---|---|
| 3,558,876 | A | * | 1/1971 | Tillman et al. | 246/169 S |
| 3,633,026 | A | * | 1/1972 | Sarbach et al. | 246/182 A |
| 4,129,276 | A | * | 12/1978 | Svet | 246/169 S |
| 4,790,190 | A | * | 12/1988 | Bambara et al. | 73/660 |
| 5,265,831 | A | | 11/1993 | Muller | 246/124 |
| 5,698,788 | A | * | 12/1997 | Mol et al. | 73/659 |
| 5,713,540 | A | | 2/1998 | Gerszberg et al. | 246/121 |
| 5,743,495 | A | | 4/1998 | Welles, II et al. | 246/121 |
| 6,020,815 | A | | 2/2000 | Eslambolchi et al. | 340/539.11 |
| 6,031,790 | A | * | 2/2000 | Futsuhara et al. | 367/96 |
| 6,216,985 | B1 | | 4/2001 | Stephens | 246/120 |
| 6,290,187 | B1 | * | 9/2001 | Egami | 246/122 R |
| 2003/0010872 | A1 | | 1/2003 | Lewin et al. | |

FOREIGN PATENT DOCUMENTS

| | | | | |
|---|---|---|---|---|
| CA | 2270066 | | 10/2000 | |
| DE | 19858937 A1 | * | 6/2000 | B61L/23/00 |
| DE | 19858937 | | 6/2000 | |
| DE | 19913057 | | 9/2000 | |
| EP | 0816200 | | 1/1998 | |
| GB | 2372569 | | 8/2002 | |
| JP | 07040834 A | * | 2/1995 | B61L/23/06 |
| JP | 10206449 A | * | 8/1998 | G01P/3/50 |

OTHER PUBLICATIONS

Rose, J.L., et al, "A Baseline and Vision of Ultrasonic Guided Wave Inspection Potential," 2002, Transactions of the ASME, Journal of Pressure Vessel Technology,124, pp. 273–282.

* cited by examiner

*Primary Examiner*—Hezron Williams
*Assistant Examiner*—Rose M. Miller
(74) *Attorney, Agent, or Firm*—Ann M. Agosti; Patrick K. Patnode

(57) ABSTRACT

A system and method for determining at least one parameter related to a train traversing on a railway track is provided. The system comprises a sensor coupled to a detection location and configured for sensing acoustic signals at the detection location on the railway track and a processor coupled to the sensor and configured for analyzing a temporal progression of a frequency spectrum corresponding to the acoustic signals

40 Claims, 2 Drawing Sheets

RAIL AND TRAIN MONITORING SYSTEM AND METHOD

BACKGROUND OF THE INVENTION

The invention relates generally to railroad conditions, and more specifically to a system and method for determining at least one parameter related to a train traveling on a railway track and the condition of the track.

In many applications, it is desirable to monitor the position and condition of trains and the condition and the safety of the railway tracks. Many approaches exist to monitor the safety of railway tracks and to detect any breaks in the rails. One common approach is the use of electric track circuits in a predefined section or block of track wherein the lack of electrical continuity serves as an indication for railroad breaks.

One problem with track circuits is that they are they are not completely accurate and effective in detecting broken rails. A significant partial break in the rail could still provide sufficient electrical path to avoid detection. A total separation of a rail could still be placed in electrical contact due to thermal expansion or other residual stress conditions. In addition, track circuits are not able to provide the location of the rail break to a resolution less than the entire length which is typically on the order of several miles.

Other approaches to detection of broken rails include installation of strain gages and fiber optic cable. One problem with such approaches is the complexity involved in the installation of such systems. Furthermore, if rail does break, repair of these monitoring is cumbersome.

Typically, individual defect detectors are used to monitor train conditions. The detectors are typically installed along the side of the track at approximately 15 to 50 mile intervals. Such detectors observe passing trains and detect anomalous conditions such as overheated bearings and wheels, out of round or flat wheels, or equipment dragging from the train. Defect detectors typically employ wheel transducers to identify the presence of the train and trigger the detector process. However, defect detectors do not include functionality to monitor the condition or integrity of the rail.

It would therefore be desirable to design a system that is accurate in determining the safety of the railway track and locating a rail break, in addition to determining various characteristics of the train traversing over the railway track.

BRIEF DESCRIPTION OF THE INVENTION

Briefly, in accordance with one embodiment of the invention, a method for determining at least one parameter related to a train traversing on a railway track is provided. The method comprises sensing high frequency acoustic signals at a detection location on the railway track and analyzing a temporal progression of a high frequency spectrum corresponding to the high frequency acoustic signals to detect an approach of the train towards the detection location on the railway track.

In another embodiment, a system for determining at least one parameter related to a train traversing on a railway track is provided. The system comprises a sensor coupled to a detection location and configured for sensing high frequency acoustic signals at the detection location on the railway track and a processor coupled to the sensor and configured for analyzing a temporal progression of a high frequency spectrum corresponding to the high frequency acoustic signals to detect an approach of the train towards the detection location on the railway track.

In another embodiment, a system to determine at least one parameter related to a train characteristic is provided. The system comprises a sensor configured for detecting low frequency acoustic signals at a detection location on a railway track, as the train is traversing over the detection location on the railway track, and a processor configured for analyzing a temporal progression of a low frequency spectrum corresponding to the low frequency acoustic signals to determine at least one parameter related to the train characteristic.

In an alternate embodiment, a method for determining a position of a rail break is provided. The method uses a speed of a train determined by analyzing acoustic signals propagated by the train while traversing over the railway track and a difference between a time of detection of a discontinuity and a time of train passage over a detection location.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE DRAWINGS

Figure 1:
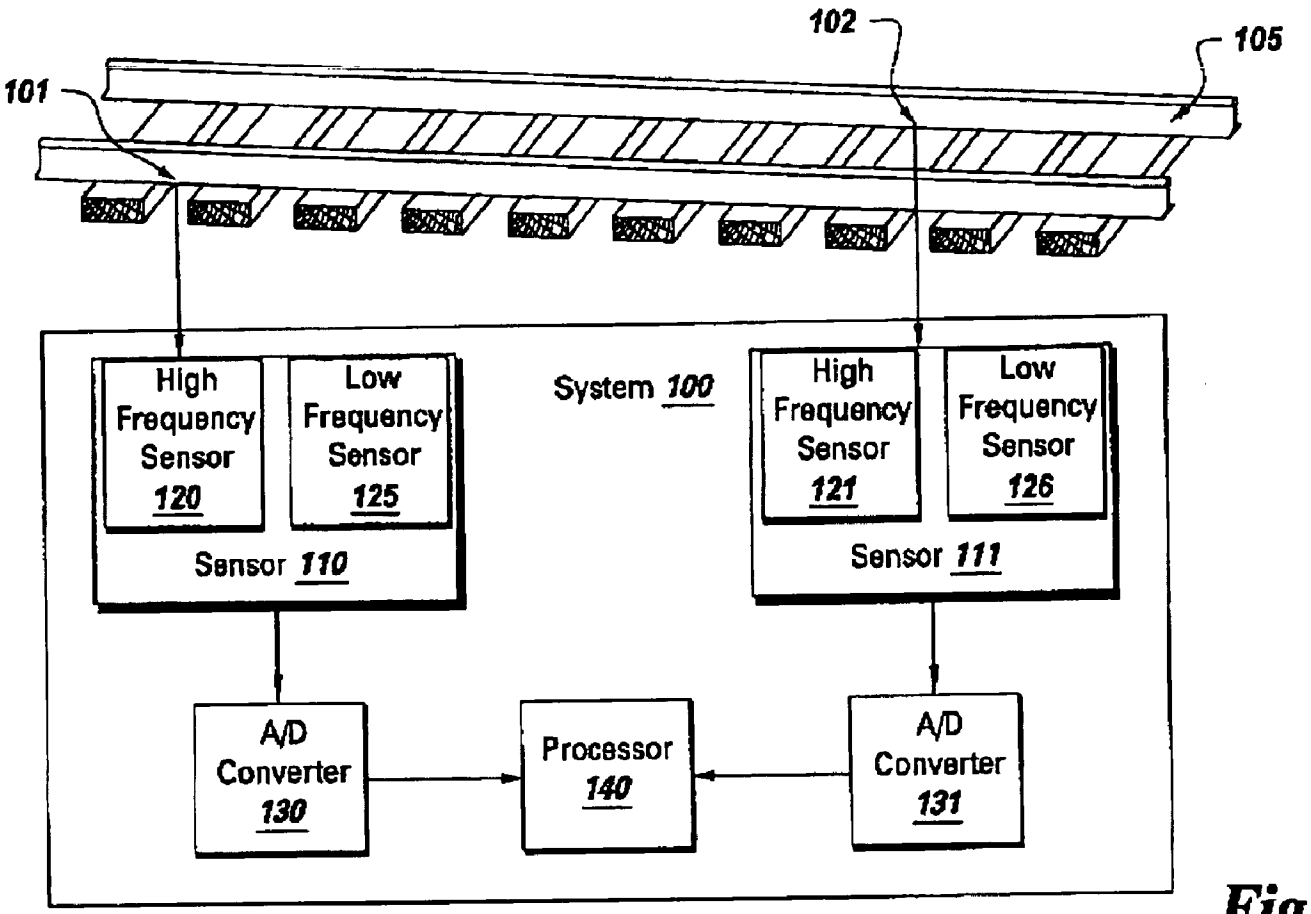
FIG. 1 is a block diagram of an embodiment of a system implemented in accordance with the invention.

FIG. 1 is a block diagram of an embodiment of system 100 implemented for determining at least one parameter related to a train traversing on railway track 105. As used herein, "train" refers to one or more locomotives with or without coupled passenger or freight cars. The system comprises a sensor 110 coupled to a detection location and configured for sensing acoustic signals at the detection location on the railway track and a processor 140 coupled to the sensor and configured for analyzing a temporal progression of a frequency spectrum corresponding to the acoustic signals. In an embodiment, the detection location is on one rail of the railway track. In one embodiment, the system further comprises an analog to digital converter 130. Processor 140 may comprise an analog processor, a digital processor, or combinations thereof. Each component is described in further detail below.

As used herein, "adapted to", "configured" and the like refer to mechanical or structural connections between elements to allow the elements to cooperate to provide a described effect; these terms also refer to operation capabilities of electrical elements such as analog or digital computers or application specific devices (such as an application specific integrated circuit (ASIC)) that are programmed to perform a sequel to provide an output in response to given input signals.

Sensor 110 is coupled to detection location 101. Sensor 110 is responsive to input acoustic signals conveyed through the rail and capable of converting the input acoustic signals to an electrical output signal. In one embodiment, sensor 110 is configured for sensing high frequency acoustic signals at the detection location on the railway track. In another embodiment, which may optionally be used in combination with the high frequency acoustic signal embodiment, the sensor is configured for detecting low frequency acoustic signals on the railway track transmitted by the train. In an alternate embodiment, the sensor is configured to detect mid-frequency acoustic signals propagated on the railway track by the train.

In an embodiment, high frequency signals comprise acoustic signals of frequency ranging from 30 kHz to 50 kHz. In an embodiment, mid frequency signals comprise acoustic signals of frequency ranging from 10 kHz to 30 kHz. In an embodiment, low frequency signals comprise acoustic signals of frequency ranging from 1 kHz to 10 kHz.

For embodiments wherein both high and low frequencies will be analyzed, the sensor has high sensitivity for high frequency signals such that high frequency signals generated by train can be detected from long distance as well as low sensitivity for low frequency signals such that low frequency signals from train passing over sensor with significant energy levels do not saturate the sensor. In one embodiment wherein high and low frequency signals are obtained and analyzed, sensor 110 comprises a high frequency sensor 120 and a low frequency sensor 125. The high frequency sensor is configured for sensing high frequency acoustic signals and the low frequency sensor configured for sensing low frequency acoustic signals. In an embodiment, sensor 110 comprises at least one accelerometer configured for appropriate frequency bandwidths. In another embodiment, sensor 110 has a broadband response covering both high and low frequency ranges with the desired high and low sensitivity respectively.

Analog to digital converter 130 is coupled to the transducer and is configured for converting the analog electrical signals to its corresponding digital representation.

Processor 140 is coupled to the analog to digital converter and, in one embodiment, is configured for analyzing a temporal progression of a high frequency spectrum corresponding to the high frequency acoustic signals to detect an approach of the train towards the detection location on the railway track.

In another embodiment processor 140 additionally analyzes the high frequency spectrum to determine a speed of the train on the railway track. Such a determination is accomplished by observing an amplitude envelope of the signals from the approaching train, the time derivative of the amplitude increase being linked to the train speed. In one embodiment, regression techniques are utilized to fit a linear or nonlinear curve to the amplitude envelope data points. The regression parameters reflect the temporal progression and speed of the train. For example, a first order, linear polynomial fit to the amplitude envelope data points provides a slope proportional to the speed of the approaching or receding train.

The processor is further configured in another more specific embodiment for, after detecting the approach of the train, detecting mid frequency acoustic signals on the railway track transmitted by the train, and analyzing the temporal progression of a frequency spectrum corresponding to the mid frequency acoustic signals to determine the speed of the train on the railway track. The speed of the train can be determined from the rate of increase in the spectral amplitude. The approach using different frequency bands provides improved estimate of train speed.

In another embodiment, processor 140 is configured for analyzing the temporal progression of a low frequency spectrum corresponding to the low frequency acoustic signals to determine at least one parameter related to a train characteristic, when the train traverses over the sensor. The amplitude of the low frequency acoustic signals is also used to determine parameters related to train characteristics. The parameters include train length, flat wheels, number of cars in the train, number of axles, sliding wheels (brake locked with wheels are sliding on rail) and axle weight. For example, distinct peaks in the low frequency acoustic signal envelope result from each passing wheel of a train. A flat wheel will impart acoustic energy of higher amplitude relative to a normal, round wheel. Thus, significantly increased peaks in signal envelope indicate presence of flat wheels. Furthermore, flat wheels impart a broader frequency spectra signal than normal wheels, which aids in detection of flat wheels as the peaks are detected in multiple frequency bands.

In an embodiment, the processor is configured for detecting a discontinuity in the high frequency signals to determine a rail break on at least one rail of the railway track. For example, in a more specific embodiment, the processor is configured for determining the rail break using an adaptive threshold, wherein the adaptive threshold is based on an estimate of a noise level in a frequency spectrum corresponding to a low frequency range.

In an alternate embodiment, also shown by FIG. 1, a second sensor 111 is configured to receive acoustic signals from the second rail of the track at detection location 102. In the illustrated embodiment, high frequency sensor 121 is configured for detecting high frequency signals and low frequency sensor 126 is configured for detecting low frequency signals.

In another embodiment, sensors 110 and 111 are configured to continuously monitor acoustic signals on both rails of the railway track. When a train approaches the sensors, the train would be first detected at the higher frequencies, and then on the lower frequencies. Processor 140 is configured to determine the rate of increase of a specific frequency component to establish the speed of the train. The detection of the train on only one rail indicates the presence of a discontinuity, and indicates a broken rail. As the train traverses the discontinuity, a sudden increase of acoustic noise on that rail is observed and the corresponding time is recorded. The time the train traverses over the sensor (sensor pass) is also established. The time of discontinuity, the time of sensor pass and the train speed are used to calculate the location of the discontinuity and hence the location of the broken rail. It may be appreciated that detected the discontinuity can be indicative of a partial break.

In another embodiment, a break in one of the rails is detected via comparison of the high frequency signals present in the opposite rail. If a similar temporal progression of high frequency signal amplitude is not observed in both rails, a break is declared in the rail which does not present such a signal. The dual rail approach provides an earlier detection of a broken rail.

In another embodiment, the processor is further configured for determining a position of the rail break by a speed of the train and a difference between a time of detection of the discontinuity and a time of train passage over the detection location. In one embodiment, the processor is configured for detecting a rail break on one rail of the track by comparing high frequency signals detected on both railway tracks.

In an another embodiment, the processor is configured for detecting the rail break and further for determining the position of the rail break by using a two dimensional time frequency representation of the acoustic signals. As will be apparent to one skilled in the art, when acoustic signals propagate in a structure, the signals having frequency components with higher velocity will arrive at the detection location before the frequency components with lower velocity. The dispersion results in an apparent temporal stretching of an acoustic signal pulse at the detection location. In general, the propagation distance is proportional to the temporal separation between frequency components. The relative time delay is typically represented by the dispersion curve. Time-frequency analysis of the received acoustic signal enables the identification of dispersion characteristics. By performing a frequency analysis on the acoustic signal over a specific time window and repeating the analysis at predetermined time intervals a two dimensional time-frequency signal representation is defined. The dispersive nature of the acoustic signals appears as a "chirp" in the time-frequency analysis representation. By estimating the slope or other shape parameters of the time-frequency components of the acoustic signal and applying knowledge of the dispersion curve, the distance over which the signal has propagated can be determined. In other words, by observing the relative temporal separation of frequency components in the time-frequency analysis representation, an estimate of the distance over which the signal has propagated can be obtained. Thus, the distance from detection location to an acoustic source transmitting the acoustic signals can be calculated. The distance, in turn, can be used to determine the position of the acoustic source as well as the rail break.

In a more specific embodiment, sensor 110 is configured for detecting broadband acoustic signals at detection location 101 on railway track 105. Processor 140 is configured for analyzing a temporal progression of a broadband frequency spectrum corresponding to the broadband acoustic signals to determine at least one parameter related to the train characteristic. In addition, the processor is further configured for determining a rail break by analyzing the broadband frequency spectrum. In one embodiment, broadband frequency signals range from 1 Hz to 50 KHz.

Figure 2:
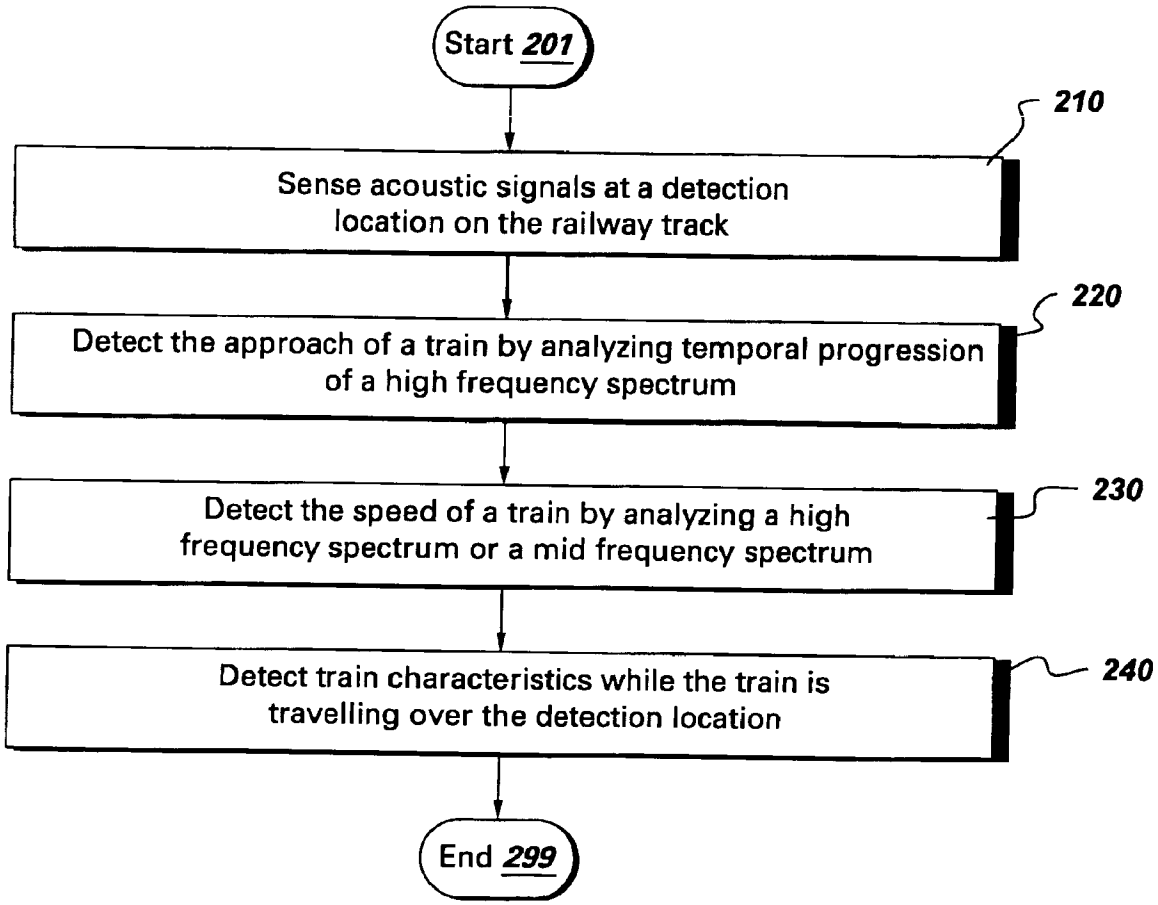
FIG. 2 is a flow chart illustrating one method by which the train characteristics are detected.

FIG. 2 is a flow chart illustrating the method for determining at least one parameter related to a train traversing on a railway track. The method begins at step 201. Each step is described below.

In step 210, acoustic signals are sensed at a detection location on the railway track. In an embodiment, high frequency acoustic signals are sensed. High frequency signals range from 30 kHz to 50 kHz. In an embodiment, as the train is traversing over the detection location, low frequency acoustic signals on the railway track are also detected alone or in combination with high frequency acoustic signals. Low frequency signals range from 1 kHz to 10 kHz. In an alternate embodiment, mid frequency signals are sensed. Mid frequency signals range from 10 kHz to 30 kHz.

In step 220, the approach of a train is detected by analyzing a temporal progression of a high frequency spectrum corresponding to the high frequency acoustic signals. In one embodiment, the distance of the acoustic signal source such as a train is detected by recognition of characteristics patterns in the time-frequency spectrum. The patterns are characteristic of theoretical dispersion modes of propagating acoustic waves. Identification of the patterns and estimation of their shape parameters, such as rate of frequency change versus time, enables location of train to be determined. For example, upon examination of hammer impacts on the railway track at different ranges, the length of the both slopes on the frequency spectrum is directly proportional to the range of the hammer impact. Furthermore, the quasi-periodic lower amplitude received from train noise exhibit a similar slope like that of the hammer impacts. By estimating the slope of the spectral components of the train noise, distance to the train can be established.

In step 230, a speed of the train is determined by analyzing a high frequency spectrum corresponding to the high frequency signals. In another embodiment, the speed of the train is determined by analyzing a mid frequency spectrum corresponding to mid frequency acoustic signals.

In an embodiment, the high frequency spectrum is analyzed to determine a rail break on the railway track. In a more specific embodiment, the high frequency spectrum is analyzed to determine a location of the rail break by using the speed of the train and a difference between a time of detection of the discontinuity and a time of train passage over the detection location.

In an alternate embodiment, the rail break is determined by using an adaptive threshold, wherein the adaptive threshold is based on an estimate of a noise level in a low frequency spectrum corresponding to low frequency acoustic signals. In another embodiment, the rail break is detected by comparing high frequency signals on both rails of the railway track.

In another embodiment, the rail break is determined by analyzing a two-dimensional time frequency representation of the received signal. The distance between a source of the acoustic signal and the detection location can be determined using the two-dimensional time frequency representation. In addition, the position of the rail break can also be determined by analyzing the two-dimensional time frequency representation.

In step 240, at least one parameter related to a train characteristic is determined while the train is traversing over the detection location. In an embodiment, parameters related to the train characteristic include train length, flat wheels, number of cars in the train, number of axles, sliding wheels, and axle weight. The parameters can be identified from patterns in the low frequency spectrum and the mid frequency spectrum corresponding to the low frequency signals mid frequency signals respectively. The speed if the train can also be determined when the train traverses over the detection location. For example, if the time that the train traversed over the sensor is known, and if the train is traveling at a constant speed, by examining the rate of decay (or increase) of specific frequency components, the speed of the train can be estimated.

The previously described embodiments of the invention have many advantages, including accurate detection of rail breaks by monitoring the acoustic energy conducted by railway track. In addition to detecting broken railway tracks the system can also detect the speed of the train, the number of cars and detect flat wheels.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method for determining at least one parameter related to a train traversing on a railway track, the method comprising:

(a) sensing high frequency acoustic signals at a detection location on the railway track;

(b) obtaining a high frequency spectrum of the high frequency acoustic signals;

(c) obtaining a temporal progression of the high frequency spectrum; and analyzing the temporal progression to detect an approach of the train towards the detection location on the railway track.

2. The method of claim 1, wherein analyzing the high frequency spectrum further comprises determining a speed of the train on the railway track.

3. The method of claim 1, further comprising, after detecting the approach of the train, detecting mid frequency acoustic signals on the railway track transmitted by the train, and analyzing the temporal progression of a mid frequency spectrum corresponding to the mid frequency acoustic signals to determine the speed of the train on the railway track.

4. The method of claim 1, further comprising, as the train is traversing over the detection location, detecting low frequency acoustic signals on the railway track, and analyzing a temporal progression of a low frequency spectrum corresponding to the low frequency acoustic signals to determine at least one parameter related to a train characteristic.

5. The method of claim 4, wherein the at least one parameter related to the train characteristic is selected from the group consisting of train length, flat wheels, number of cars in the train, number of axles, sliding wheels and axle weight.

6. The method of claim 1, wherein the analyzing further comprises determining a two dimensional time frequency representation of the received signal.

7. The method of claim 6, wherein the determining further comprises determining a distance between a source of the acoustic signal and the detection location using the two dimensional time frequency representation.

8. The method of claim 6, wherein the determining further comprises:

detecting a rail break on at least one rail of the railway track; and locating a position of the rail break.

9. The method of claim 8, wherein the locating the position of the rail break comprises using the two dimensional time frequency representation.

10. The method of claim 8, wherein the locating the position of the rail break comprises using a speed of the train and a difference between a time of detection of the discontinuity and a time of train passage over the detection location.

11. The method of claim 8, wherein the rail break is detected by detecting a discontinuity in the high frequency signals to determine the rail break.

12. The method of claim 8, wherein the rail break is detected by using an adaptive threshold, wherein the adaptive threshold is based on an estimate of a noise level in a frequency spectrum corresponding to the received acoustic signals.

13. The method of claim 8, wherein the rail break is detected by comparing high frequency signals on both rails of the railway track.

14. A system for determining it least one parameter related to a train traversing on a railway track, the system comprising:

(a) a sensor coupled to a detection location and configured for sensing high frequency acoustic signals at the detection location on the railway track; and (b) a processor coupled to the sensor and configured for obtaining a high frequency spectrum of the high frequency acoustic signals, obtaining a temporal progression of the high frequency spectrum, and analyzing the temporal progression to detect an approach of the train towards the detection location on the railway track.

15. The system of claim 14, wherein the processor analyzes the high frequency spectrum to determine a speed of the train on the railway track.

16. The system of claim 14, wherein the processor is further configured for, after detecting the approach of the train, detecting mid frequency acoustic signals on the railway track transmitted by the train, and analyzing the temporal progression of a frequency spectrum corresponding to the mid frequency acoustic signals to determine the speed of the train on the railway track.

17. The system of claim 14, wherein the sensor is further configured for:

detecting low frequency acoustic signals on the railway track transmitted by the train, and the processor is further configured for analyzing a temporal progression of a low frequency spectrum corresponding to the low frequency acoustic signals to determine at least one parameter related to a train characteristic, when the train traverses over the sensor.

18. The system of claim 17, wherein the at least one parameter related to train characteristic is selected from the group consisting train length, flat wheels, number of cars in the train, number of axles, sliding wheels and axle weight.

19. The system of claim 14, wherein the processor is further configured for determining a two dimensional time frequency representation of the received signal.

20. The system of claim 19, wherein the processor is further configured for determining a distance between a source of the acoustic signal and the detection location using the two dimensional time frequency representation.

21. The system of claim 20, wherein the processor is further configured for:

detecting a rail break on at least one rail of the railway track; and locating a position of the rail break.

22. The system of claim 21, wherein the processor is configured for locating the rail break using the two-dimensional time frequency representation.

23. The system of claim 21, wherein the processor is further configured for locating the rail break by using a speed of the train and a difference between a time of detection of the discontinuity and a time of train passage over the detection location.

24. The system of claim 21, wherein the processor is further configured for detecting the rail break by detecting a discontinuity in the high frequency signals.

25. The system of claim 21, wherein the processor is configured for detecting the rail break using an adaptive threshold, wherein the adaptive threshold is based on an estimate of a noise level in a frequency spectrum corresponding to the received acoustic signals.

26. The system of claim 21, wherein the processor is configured for detecting the rail break on one rail of the railway track by comparing high frequency signals on both rails of the railway track.

27. The system of claim 14, further comprising an analog to digital converter coupled to the transducer and configured for converting the electrical signals to corresponding digital signals, the digital signals being provided to the processor.

28. The system of claim 14, wherein the sensor comprises:

a high frequency sensor configured for sensing high frequency acoustic signals; and a low frequency sensor configured for sensing low frequency acoustic signals.

29. A system to determine at least one parameter related to a train characteristic, the system comprising:

a sensor configured for detecting low frequency acoustic signals at a detection location on a railway track, as the train is traversing over the detection location on the railway track, and a processor configured for obtaining a low frequency spectrum of low frequency acoustic signals, obtaining a temporal progression of the low frequency spectrum, and analyzing the temporal progression to determine at least one parameter related to the train characteristic.

30. The system of claim 29, wherein the at least one parameter related to the train characteristic is selected from the group consisting of train length, flat wheels, number of cars in the train, number of axles, sliding wheels and axle weight.

31. A method for determining a position of a rail break, the method comprising:

analyzing acoustic signals propagated by a train while traversing over the railway track to determine a speed of the train:

detecting a rail break on the railway track at a time of detection.

determining a difference between the time of detection and a time of train passage over a detection location.

32. The method of claim 31, wherein the rail break is detected by using an adaptive threshold, wherein the adaptive threshold is based on an estimate of a noise level in a frequency spectrum corresponding to the received acoustic signals.

33. The method of claim 31, wherein the rail break is detected by comparing high frequency signals on both rails of the railway track.

34. The method of claim 31, wherein the position of the rail break is determined by analyzing a two dimensional time frequency representation of the received acoustic signals.

35. A system to determine at least one parameter related to train traveling on a railway track, the system comprising:

a sensor configured for detecting broadband acoustic signals at a detection location on the railway track; and a processor configured for obtaining a broadband frequency spectrum of the broadband acoustic signals, obtaining a temporal progression of the broadband frequency spectrum, and analyzing the temporal progression to determine at least one parameter related to a train characteristic.

36. The system of claim 35, wherein the at least one parameter related to the train characteristic is selected from the group consisting of train length, flat wheels, number of cars in the train, number of axles, sliding wheels and axle weight.

37. The system of claim 35, wherein the processor is further configured to determine a two dimensional time frequency representation at the broadband acoustic signals.

38. The system of claim 37, wherein the processor is further configured for detecting a rail break on at least one rail of the railway track and locating a position of the rail break.

39. The system of claim 37, wherein processor is configured for determining the rail break by analyzing the broadband frequency spectrum.

40. The system of claim 37, wherein the processor is configured for detecting the rail break and locating the position of the rail break using the two dimensional time frequency representation of the broadband signal.

* * * * *

UNITED STATES PATENT AND TRADEMARK OFFICE

CERTIFICATE OF CORRECTION

PATENT NO. : 6,951,132 B2
APPLICATION NO. : 10/609832
DATED : October 4, 2006
INVENTOR(S) : Davenport et al.

It is certified that error appears in the above-identified patent and that said Letters Patent is hereby corrected as shown below:

Col. 7, Claim 14, line 1, replace the word “it” with --at--.

Col. 10, Claim 37, line 3, replace the word “at” with --of--.

Signed and Sealed this

Sixth Day of February, 2007

JON W. DUDAS
*Director of the United States Patent and Trademark Office*

UNITED STATES PATENT AND TRADEMARK OFFICE

CERTIFICATE OF CORRECTION

PATENT NO. : 6,951,132 B2
APPLICATION NO. : 10/609832
DATED : October 4, 2005
INVENTOR(S) : Davenport et al.

It is certified that error appears in the above-identified patent and that said Letters Patent is hereby corrected as shown below:

Col. 7, Claim 14, line 1, replace the word “it” with --at--.

Col. 10, Claim 37, line 3, replace the word “at” with --of--.

This certificate supersedes Certificate of Correction issued February 6, 2007.

Signed and Sealed this

Sixth Day of March, 2007

JON W. DUDAS
*Director of the United States Patent and Trademark Office*